US007832108B2

(12) United States Patent
Sterios-Primiani

(10) Patent No.: US 7,832,108 B2
(45) **Date of Patent: *Nov. 16, 2010**

(54) PENCIL SHARPENER CAP

(76) Inventor: Leanna Sterios-Primiani, 514 Alta Ave., Santa Monica, CA (US) 90402-2716

( * ) Notice: Subject to any disclaimer, the term of this patent is extended or adjusted under 35 U.S.C. 154(b) by 0 days.

This patent is subject to a terminal disclaimer.

(21) Appl. No.: 12/359,208

(22) Filed: Jan. 23, 2009

(65) Prior Publication Data

US 2009/0126207 A1 May 21, 2009

Related U.S. Application Data

(63) Continuation-in-part of application No. 11/582,633, filed on Oct. 17, 2006, now abandoned, which is a continuation of application No. 10/247,183, filed on Sep. 18, 2002, now Pat. No. 7,143,516.

(51) Int. Cl.
*B43L 23/00* (2006.01)

(52) U.S. Cl. ..... 30/454; 30/461

(58) Field of Classification Search ..... 30/461, 30/453–455; 401/50, 51; D19/73
See application file for complete search history.

(56) References Cited

U.S. PATENT DOCUMENTS

| | | | | |
|---|---|---|---|---|
| 965,263 | A * | 7/1910 | Welles | 144/28.11 |
| 1,306,903 | A | 6/1919 | Imaizumi | 30/452 |
| 1,832,272 | A | 11/1931 | Zimdars | 401/51 |
| 1,958,461 | A | 5/1934 | Wright | 30/457 |
| 2,198,984 | A | 4/1940 | Hammer-Purgstall | 401/51 |
| 2,333,714 | A | 11/1943 | Fletcher | 30/457 |
| 2,514,761 | A | 7/1950 | Egil | 144/28.11 |
| 2,565,715 | A * | 8/1951 | Becker et al. | 401/51 |
| 2,757,638 | A | 8/1956 | Goldstein | 144/28.11 |
| 2,769,428 | A | 11/1956 | Onanian | 144/28.4 |
| 3,232,275 | A | 2/1966 | Ziegler | 401/50 |
| 3,288,113 | A | 11/1966 | Gabler | 401/52 |
| 4,231,405 | A | 11/1980 | Vila | |
| 4,269,523 | A | 5/1981 | Kay | 401/51 |
| 4,513,798 | A | 4/1985 | Luttgens | |
| 5,599,123 | A | 2/1997 | Still | 30/454 |
| 5,647,138 | A | 7/1997 | Tang | 8/531 |
| 6,132,476 | A | 10/2000 | Lunsford | 30/454 |

(Continued)

FOREIGN PATENT DOCUMENTS

| | | | |
|---|---|---|---|
| DE | 3145536 | A | 5/1983 |

(Continued)

*Primary Examiner*—Kenneth E. Peterson
(74) *Attorney, Agent, or Firm*—Lewis Anten

(57) ABSTRACT

A pencil sharpener includes a housing having an inner cavity for receiving at least a portion of a pencil therein. The pencil includes a center portion and an outer portion generally coaxial with the center portion. A sharpener is longitudinally slidable within the inner cavity. A mechanism provides a linear force to the sharpener to move the sharpener between open and closed ends of the housing. The linear force mechanism is disposed between the sharpener and the closed end of the housing. The engagement of the pencil and housing during sharpening of the pencil produces shavings from the center and outer portions of the pencil that are retained within the inner cavity. A combined longitudinal length of the housing and pencil in an engaged configuration remains approximately constant as the pencil decreases in length from use and/or sharpening.

11 Claims, 8 Drawing Sheets

U.S. PATENT DOCUMENTS

| | | | | |
|---|---|---|---|---|
| 6,286,218 | B1 | 9/2001 | Luttgens | 30/454 |
| 6,381,856 | B2 | 5/2002 | Luttgens | 30/454 |
| 6,397,480 | B1 | 6/2002 | Mak et al. | |
| 6,427,343 | B1 | 8/2002 | Chang | 30/454 |
| 2001/0052188 | A1 | 12/2001 | Luttgens | 30/454 |
| 2005/0044730 | A1 | 3/2005 | Fischer | 30/454 |
| 2009/0129850 | A1* | 5/2009 | Schmidt et al. | 401/50 |

FOREIGN PATENT DOCUMENTS

| | | |
|---|---|---|
| JP | 48093415 | 12/1973 |
| JP | 6-199093 | 7/1994 |

* cited by examiner

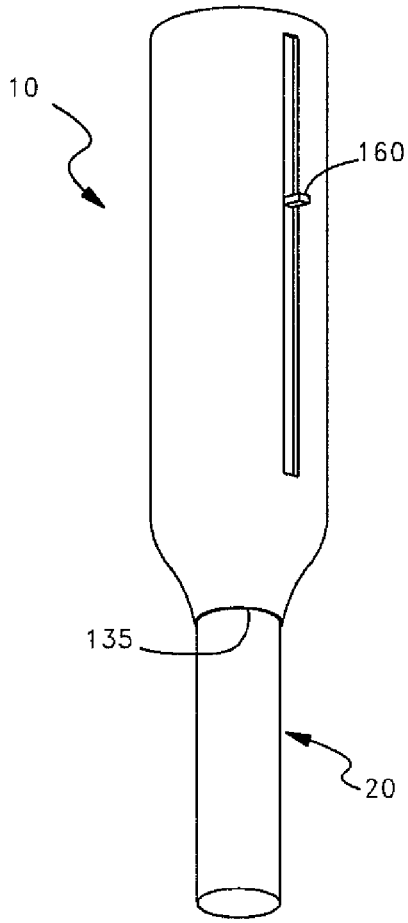
FIG.3
FIG. 4
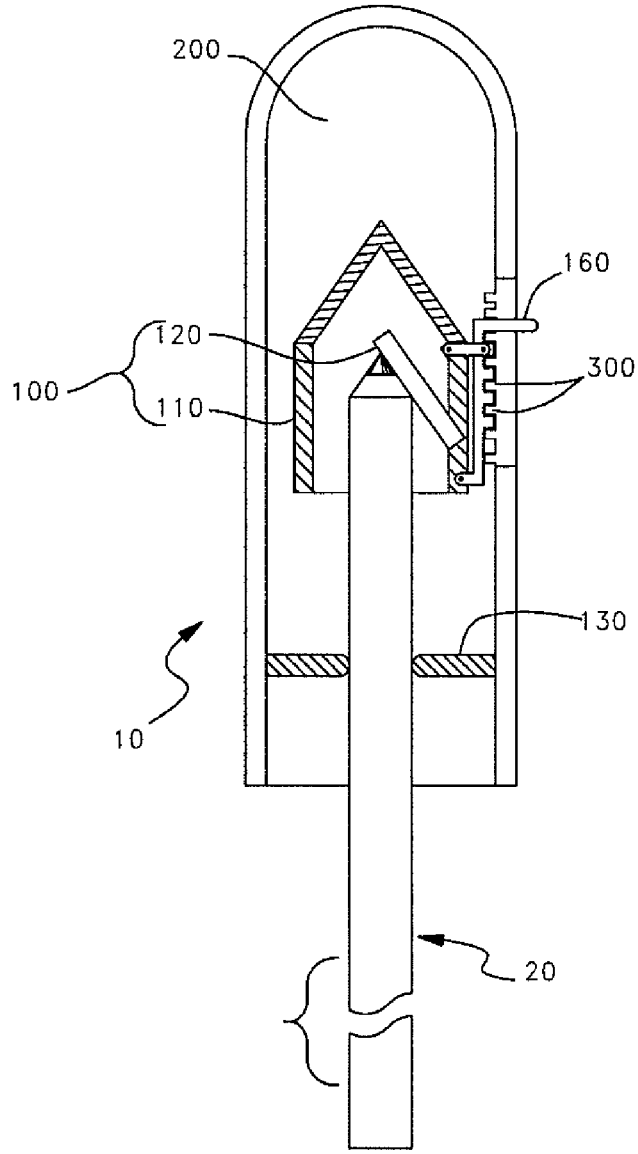

PENCIL SHARPENER CAP

CROSS-REFERENCE TO PRIOR APPLICATIONS

This application is a continuation-in-part of U.S. patent application Ser. No. 11/582,633, filed on Oct. 17, 2006, now abandoned, which is a continuation of U.S. patent application Ser. No. 10/247,183, filed on Sep. 18, 2002, now U.S. Pat. No. 7,143,516, and claims the priority and benefit of those applications which are incorporated by reference herein in their entirety.

U.S. GOVERNMENT SUPPORT

Not Applicable

BACKGROUND OF THE INVENTION

The present invention generally relates to a pencil sharpener. More particularly, the present invention relates to a pencil sharpener cap.

Pencils have been used for many years and are widely distributed. Generally, there are two common types of pencils: wooden pencils and mechanical pencils.

Wooden pencils suffer from several disadvantages. One disadvantage is that wooden pencils often become blunt upon use. Another disadvantage of wooden pencils is that the lead breaks easily, during both use and transport. Still another disadvantage is that handling wooden pencils is often messy because the lead is usually exposed and can rub off on clothing, hands, and other items. Furthermore, if the lead breaks, disposing of the broken piece of lead becomes a nuisance. This is even more problematic when using cosmetic pencils because the "lead" is so soft and breaks easily.

One method of overcoming at least some of those disadvantages is to carry several sharpened wooden pencils in order to account for dulling or breaking of the lead. However, carrying several wooden pencils is extremely inconvenient, especially because it is difficult to estimate how many pencils will be needed.

Mechanical pencils, sometimes referred to as propelling pencils, are a partial substitute for wooden pencils. Mechanical pencils eliminate the need to sharpen pencils because the lead is so small in diameter that it never needs sharpening. However, mechanical pencils also suffer from several disadvantages. For example, mechanical pencils are not especially useful to artists in shading their drawings as the smallness of the lead's diameter makes the lead brittle under flexure and the lead tip therefore susceptible to breaking off if too much pressure is applied to the side of the lead.

Another method of overcoming at least some of those disadvantages is to keep a pencil sharpener handy. However, that solution is also problematic for several reasons. First, one must remember to always keep a pencil sharpener handy. Second, it is inconvenient to have to carry both a pencil and a sharpener, especially when space is limited. Furthermore, sharpening a pencil can be messy, especially if the sharpener does not contain a cavity to catch the shavings.

Some manufacturers have introduced pencils with attached sharpeners to try to overcome some of those disadvantages. However, those pencil-attached pencil sharpeners still suffer from disadvantages. For example, some pencil-attached pencil sharpeners do not contain a cavity to catch shavings, which would make sharpening the pencil messy and time consuming. Furthermore, in pencil-attached pencil sharpeners, although the length of the pencil together with the cap becomes shorter as the pencil is sharpened, carrying the pencils when they are new and longer is difficult, especially cosmetic pencils that are typically carried in a purse or other small compartment.

Accordingly, there is a need for an improved pencil-attached pencil sharpener. There is also a need for a sharpening device that permits a pencil to be sharpened while the sharpening device retains all or nearly all of the pencil's shavings. There is a further need for a sharpening device where the sharpening device's capacity for retaining pencil shavings is able to increase as the pencil is used up. There is an additional need for a sharpening device where a combined longitudinal length of the device and pencil in an engaged configuration remains approximately constant as the pencil decreases in length due to sharpening. The present invention satisfies these needs and provides other related advantages.

SUMMARY OF THE INVENTION

The present invention is useful in a variety of ways. The pencil sharpener embodying the present invention provides a way to retain all or nearly all of a pencil's shavings. The pencil sharpener cap is also able to provide a user with an expanded capacity for shavings retention as the pencil is sharpened and used up.

In accordance with an embodiment of the present invention, a pencil sharpener comprises a housing having an inner cavity for receiving at least a portion of a pencil therein. The pencil comprises a center portion and an outer portion generally coaxial with the center portion. A sharpener is longitudinally slidable within the inner cavity. There is a mechanism for providing a linear force to the sharpener. The linear force mechanism is disposed between the sharpener and the closed end of the housing. The linear force mechanism can come in various forms including, without limitation, a spring.

The housing comprises a substantially tubular body. The housing includes a mechanism for removably coupling the housing to the pencil. The removably coupling mechanism can include a retention ring that engages the pencil.

Sharpening of the pencil produces shavings of the center and outer portions of the pencil. The inner cavity retains the shavings between the sharpener and the closed end of the housing. The inner cavity includes a shavings reservoir varying in size as the sharpener longitudinally moves between the open and closed ends of the housing. An end of the sharpener defines a first end of the shavings reservoir and the closed end of the housing defines a second end of the shavings reservoir opposite the first end.

The pencil sharpener includes a removable closure for enclosing the open end of the housing. The closure includes a recess for receiving a portion of the pencil therein as well as a gripping surface area. Rotation of the closure relative to the housing sharpens the pencil during engagement of the housing and closure. Rotation of the pencil relative to the housing also sharpens the pencil during engagement of the housing and pencil.

The pencil sharpener includes a mechanism for guiding the sharpener between open and closed ends of the housing. The guiding mechanism includes a pair of parallel grooves disposed on opposite sides of the inner cavity where the sharpener engages the grooves. The guiding mechanism also includes a pair of tabs extending from the sharpener with each tab engaging the housing.

The pencil sharpener includes an insert disposed within the open end of the housing, between the pencil and the housing. The insert comprises an aperture and a flexible membrane having slits substantially aligned with the aperture for retention of pencil shavings within the housing.

A combined longitudinal length of the housing and pencil in an engaged configuration remains approximately constant as the pencil decreases in length from use and/or sharpening.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a perspective front view of a third embodiment of a pencil sharpener cap coupled to a pencil;

FIG. 4 is a vertical cross-section of a fourth embodiment of a pencil sharpener cap and pencil;

DETAILED DESCRIPTION OF THE PREFERRED EMBODIMENTS

The present invention is a useful pencil sharpening construction that permits a pencil to be sharpened while retaining all or nearly all of the pencil shavings. The present invention provides a sharpening device where the sharpening device's capacity for retaining pencil shavings is able to increase as the pencil is used up. The present invention further provides a sharpening device where a combined longitudinal length of the device and pencil in an engaged configuration remains approximately constant as the pencil decreases in length due to sharpening.

Figure 1:
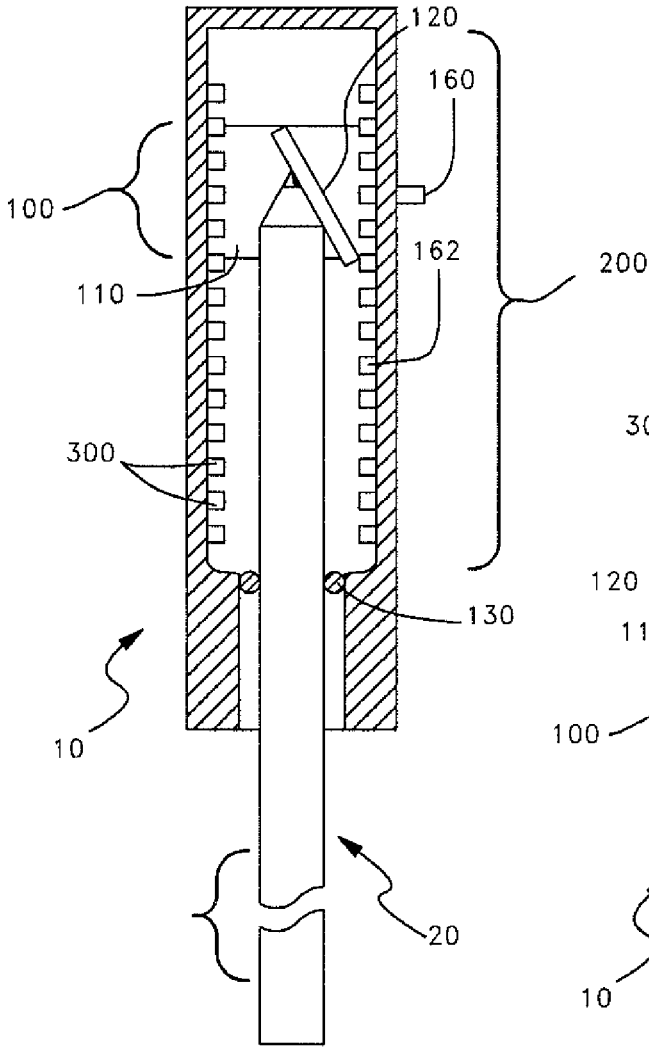
FIG. 1 is a vertical cross-section of a first embodiment of a pencil sharpener cap coupled to a pencil.

As shown in the drawings for purposes of illustration, the present invention is concerned with a pencil sharpener device, as seen in FIGS. 1-12. FIG. 1 generally comprises a pencil sharpener cap 10 that removably receives a pencil 20. The pencil sharpener cap 10 generally comprises a sharpener 100, a variable-size shavings reservoir 200, and a mechanism 300 for changing the size of the shavings reservoir 200.

Pencils 20 generally have a relatively hard covering and a relatively soft center. The covering may comprise any plastic, wood, paper, or polymer that sufficiently protects the soft center from breaking or smearing. The "center" of a pencil 20 is sometimes referred to as "lead" although even in drawing pencils, the "lead" is a misnomer and actually refers to graphite material. As used herein, the term "center" can comprise any material or compound including wax, lead, graphite, plastic polymer, drugs, pharmaceuticals, cosmetics, etc. that can be formulated to be delivered through a pencil. Pencils 20 may be any standard or non-standard sized pencil 20, including narrow to wide diameter pencils. It is especially contemplated that pencils 20 include cosmetic pencils, including eye pencils, lip pencils, and other make-up pencils.

The sharpener 100 generally comprises a housing 110 and a cutter 120. The housing 110 may comprise any durable material that is capable of holding pencil 20 in place during sharpening without squashing or damaging the pencil. Thus, contemplated materials comprising the housing 110 include plastic, and possibly hard rubber. In preferred embodiments, the housing 110 is sized and dimensioned to create a desired shape to fit narrow or wide diameter pencils.

Cutter 120 is contemplated to comprise any durable cutting material, preferably rust-proof material, including stainless steel, aluminum, metal alloy, or hard plastic material or polymer. Positioning of the cutter 120 likely affects the sharpness/bluntness of the soft center after sharpening. The cutter 120 is typically positioned at least forty-five (45) degrees from the normal angle to create a very sharp tip, and less than twenty (20) degrees from the normal angle to create a blunt tip. It is contemplated that the cutter is positioned so as to minimize jamming of the soft center of a pencil 20.

Cap 10 has a retention mechanism that removably couples the cap 10 to a corresponding pencil 20. FIG. 1 depicts a retention mechanism that is a snap fit mechanism, with a retention ring 130 placed near the open end of the cap 10 to provide a gripping and retention mechanism between the cap 10 and the corresponding pencil 20. The retention ring 130 works in a fashion similar to that of many common plastic pens and their corresponding caps. Other contemplated retention mechanisms include friction or compression collar mechanisms 135, as depicted in FIG. 3. When a friction or compression collar mechanism is used, the cap 10 is pressed onto the pencil 20 until the cap 10 is relatively securely held in place.

Figure 2:
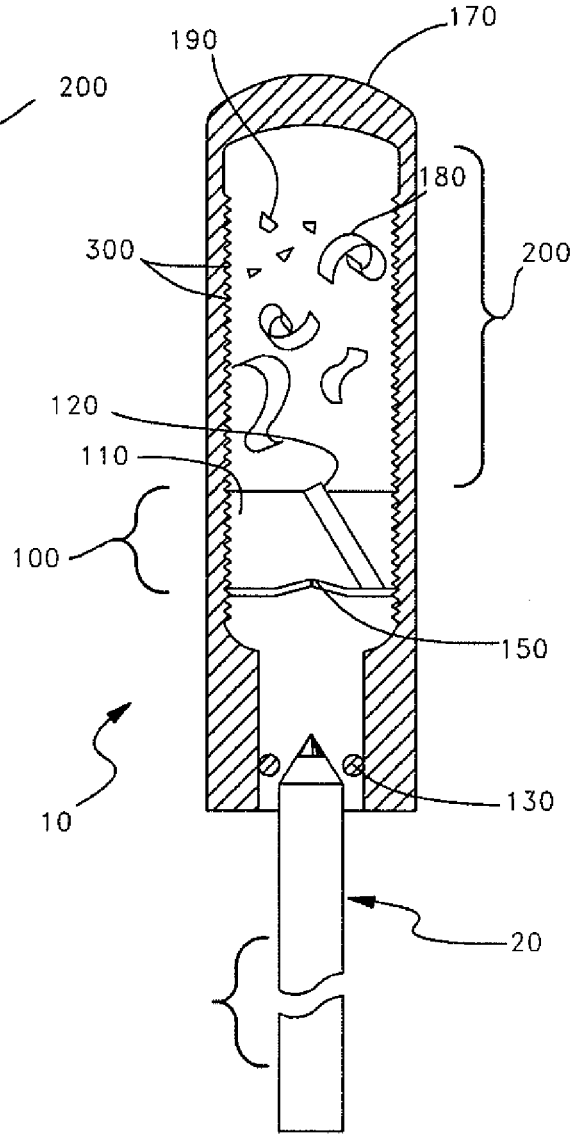
FIG. 2 is a vertical cross-section of a second embodiment of a pencil sharpener cap and a corresponding pencil.

Further contemplated embodiments include kits comprising a pencil 20 and a corresponding pencil sharpener cap 10 that are sized and dimensioned so that when the cap 10 covers the pencil 20, the length of the cap 10 together with the pencil 20 remain approximately a constant size as the pencil 20 is used and sharpened. This is depicted in FIGS. 1 and 2. Thus, when the pencil 20 is full-length, a larger portion of the pencil 20 will fit inside the cap 10, and as the pencil 20 becomes smaller, less of the pencil 20 fits inside the cap 10. The cap 10 preferably has a length at least 50% or even 75% that of the length of the corresponding pencil 20. Viewed from another perspective, when a full-length pencil 20 is stored within the cap 10, the lumen of the cap 10 may receive at least 50%, or even 75% that of the length of the pencil 20.

In FIG. 2, biased flaps 150 are used in the pencil sharpener cap 10 to prevent shavings 180 or lead 190 from the cutter 120 or the reservoir 200 from falling out. The biased flaps 150 are preferably positioned near or on the sharpener 100 so that when a pencil 20 is inserted into the cap 10 and sharpener housing 110, the biased flaps 150 open to allow insertion of the pencil 20. Furthermore, when the pencil 20 is pulled out, the biased flaps 150 close once the pencil 20 is removed and remain in a closed position, which tends to prevent shavings 180 and other debris from falling out. It is especially preferred that the biased flaps 150 are positioned on the sharpener 100 at a point near where the pencil 20 is inserted into the sharpener 100 so as to catch and prevent all the shavings 180 and other debris from falling out of the cap 10.

The shavings reservoir 200 is the space between the closed end of the cap 10 and the sharpener 100. The shavings reservoir 200 is capable of holding at least some of the shavings 180 from the corresponding pencil 20. In preferred embodiments, the shavings reservoir 200 holds all the shavings 180 from a corresponding pencil 20. Thus, the shavings reservoir 200 may be sized and dimensioned to hold a volume of between fifteen (15) and one hundred (100) cc, and more preferably between thirty (30) and sixty (60) cc. The key is that the maximum size of the shavings reservoir 200 should be capable of holding all the shavings 180 from one pencil 20.

It is further contemplated that at least one of the interior wall, exterior wall, and sharpener 100 is moved in order to increase or decrease the size of the shavings reservoir 200. The internal wall may comprise a portion of the sharpener 100. The external wall may be telescopically coupled to the sharpener 100. The mechanism through which the shavings reservoir 200 moves is discussed in detail below.

The cap 10 is injection molded and has a substantially uniform wall thickness so that the shape of the reservoir 200 is approximately the same shape as the outer portion of the cap 10. The outer portion of the cap 10 may comprise any suitable shape including substantially tubular, substantially rectangular, polygonal with at least five sides, or any other shape that is easy to handle and transport such as in a purse, pocket, or briefcase. In preferred embodiments, the cap 10 is substantially tubular with a tapered end.

A notch-type mechanism may be used to move the shavings reservoir 200. A notch-type mechanism functions in a manner that allows one to manually slide the sharpener 100 away from the opening of the cap 10 to decrease the size of the shavings reservoir 200 or down the cap 10 to increase the size of the shavings reservoir 200. FIGS. 1 and 3 depict a notch-type mechanism where a tab 160 is coupled to the sharpener 100 and extends to the periphery of the cap 10 to allow one to manually slide the tab 160 notch-to-notch along a plurality of notches 162, up and down the cap 10 in order to move the sharpener 100.

In FIG. 2, the retention mechanism 300 is a screw type mechanism. The sharpener 100 is typically placed on grooves (i.e., screw threads) so that the sharpener 100 is carried along the screws to increase or decrease the size of the shavings reservoir 200 as screw threads of the sharpener 100 and the cap 10 move relative to one another. The screws can be turned by any known mechanism, including a dial, rotary actuator 170, or other type of handle. FIG. 2 depicts a rotary actuator located at the tapered end of the cap 10. Another less preferred embodiment includes coupling the rotation of the pencil 20 during sharpening to the movement of the sharpener 100 so that as the pencil 20 is sharpened, the sharpener 100 moves toward the open end of the cap 10. The twisting of the sharpener 100 may or may not be coupled to the twisting of the pencil 20 during sharpening.

FIGS. 5-11 illustrate an embodiment of a pencil sharpener assembly 400 that includes a housing 402, illustrated in the form of a cap 404 having a generally elongated, substantially cylindrical, tubular body. The housing 402 has an open end 406, a closed end 408, and an inner cavity 410 for receiving at least a portion of a pencil 412 therein. The pencil 412 comprises a center portion 414 (i.e., a relatively soft center) and an outer portion 416 (i.e., a relatively hard covering) generally surrounding the center portion 414, coaxial to the center portion 414 and is otherwise similar and/or identical to the pencils 20 discussed above. The outer portion 416 may be made from a variety of materials including, without limitation, any plastic, wood, paper, or polymer that sufficiently protects the relatively soft center portion 414 from breaking or smearing. As discussed above, the center portion 414 of the pencil 412 is sometimes referred to as "lead" although even in drawing pencils, the "lead" is a misnomer and is actually graphite material. The center portion 414 may be made from a variety of materials including, without limitation, wax, lead, graphite, plastic polymer, drugs, pharmaceuticals, cosmetics, etc. that can be formulated to be delivered through a pencil. The pencils 412 may be any standard or non-standard sized pencil 412, including narrow to wide diameter pencils. It is especially contemplated that the pencils 412 include cosmetic pencils, including eye pencils, lip pencils, and other make-up pencils.

A sharpener 418 is similar and/or identical to the sharpeners 100 discussed above, except that the sharpener 418 is longitudinally slidable within the inner cavity 410 along grooves 424 that engage tabs 426 of the sharpener 418, as outlined below. The sharpeners 100, 418 are similar in form and/or function to conventional pencil sharpeners, but structurally configured as described above and below. The inner cavity 410 comprises a shavings reservoir varying in size as the sharpener 418 longitudinally moves between the open and closed ends 406, 408 of the housing 402. An end of the sharpener 418 defines a first end of the shavings reservoir and the closed end 408 of the housing 402 defines a second end of the shavings reservoir opposite the first end. The inner cavity 410 is capable of holding at least some of the shavings 430 from the corresponding pencil 412, but preferably most, if not all, of the shavings 430 from a corresponding pencil 412. Thus, the inner cavity 410 may be sized and dimensioned to hold a volume of between fifteen (15) and one hundred (100) cc, and more preferably between thirty (30) and sixty (60) cc. The maximum size of the inner cavity 410 is capable of holding all the shavings 430 from a single pencil 412.

The sharpener 418 may be made from a variety of durable materials that are capable of holding the pencil 412 in place during sharpening without squashing or damaging the pencil 412. Various materials from which the sharpener 418 can be made include, without limitation, plastic, hard rubber or the like. In preferred embodiments, the sharpener 418 may be sized and dimensioned to create a desired shape to fit narrow or wide diameter pencils 412. The sharpener 418 includes a cutter 420 that can be made of various durable, preferably rust-proof materials including, without limitation, stainless steel, aluminum, metal alloy, hard plastic material, polymer or the like. The cutter 420 is similar and/or identical to the cutters 120 discussed above. Positioning of the cutter 420 likely affects the sharpness/bluntness of the center portion 414 after sharpening. The cutter 420 is typically positioned at least forty-five (45) degrees from the normal angle to create a very sharp tip, and less than twenty (20) degrees from the normal angle to create a blunt tip. It is contemplated that the cutter 420 is positioned so as to minimize jamming of the center portion 414 of the pencil 412.

The assembly 400 also includes a mechanism 422 for guiding the sharpener 418 between the open and closed ends 406, 408 of the housing 402. The guiding mechanism 422 can be in the form of a pair of parallel slots or grooves 424 disposed on opposite sides of the inner cavity 410, and the sharpener 418 engages the grooves 424. The sharpener 418 includes a pair of tabs 426 disposed on opposite sides of the sharpener 418 and extending away therefrom to engage the housing 402 (i.e., each tab 426 is sized and/or shaped to engage a respective one of the grooves 424). The pair of tabs 426 are part of the guiding mechanism 422. The tabs 426 and grooves 424 are linear, extending respectively along at least a portion of the length of the sharpener 418 and the internal wall of the housing 402. Alternatively, the tabs 426 and grooves 424 may be spiral/curvilinear respectively along at least a portion of the length of the sharpener 418 and the internal wall of the housing 402. The placement of the tabs 426 and grooves 424 may be reversed with the tabs 426 extending from the internal wall of the housing 402 and the grooves 424 formed on the sharpener 418 with the tabs 426 and grooves 424 engaging each other in the manner described above. The engagement of the tabs 426 and grooves 424 allows the sharpener 418 to slide within the housing 402 along the length of the housing 402.

The assembly 400 further includes a mechanism 428 for providing a linear force to the sharpener 418 which biases the sharpener 418 to move towards the open end 406 of the housing 402. The linear force mechanism 428 is disposed between the sharpener 418 and the closed end 408 of the housing 402. Sharpening of the pencil 412 produces shavings 430 of the center and outer portions 414, 416 of the pencil 412. The linear force mechanism 428 comes in various forms including, without limitation, a coil or helical spring, a compression spring, a tension spring, a rubber band or the like. The spring can be made of various materials including, without limitation, steel. Alternatively, the closed end 408 comprises a removable cap (not shown) that is removably connected to the housing 402 in order to assist with the manufacture of the assembly 400 (e.g., positioning of the linear force mechanism 428 within the inner cavity 410). The removable cap (not shown) can snap-fit to or friction-fit engage the closed end 408 of the housing 402 via a neck that extends from the cap into the inner cavity 410 of the housing 402. For example, the removable cap (not shown) can engage the housing 402 via a tab extending away from the neck of the removable cap (not shown) that engages an aperture on the housing 402 near the closed end 408. In another alternative, the spring or rubber band may be attached to the housing 402 near the open end 406 and connected to the sharpener 418 so as to bias the sharpener 418 towards the open end 406 of the housing 402. Insertion of the pencil 412 into the sharpener 418 pushes the sharpener 418 towards the closed end 408 of the housing 402, placing tension on the spring or rubber band which will then bias the sharpener 418 back towards the open end 406 as the pencil 412 is removed from the housing 402.

The pencil sharpener assembly 400 includes a removable closure 432 for enclosing the open end 406 of the housing 402. The closure 432 can be in the form of an endcap having a generally elongated, substantially tubular body having a tapered end. The closure 432 includes a recess 434 for receiving a portion of the remaining length of the pencil 412 therein (i.e., the portion of the pencil 412 that does not extend into the housing 402). The recess 434 is generally cylindrical, sized and shaped to match the exterior of the pencil 412. In this manner, an interior wall defining the recess 434 can be circular or polygonal in cross-section in order to approximately match the cross-sectional shape of the pencil 412. However, there need not be an identical match in the cross-sectional shapes of the pencil 412 and the recess 434. The pencil 412 can friction-fit engage the recess 434 of the closure 432 or the closure 432 can be crimped on the end of the pencil 412 like an eraser on a conventional writing pencil. In the alternative, a glue, adhesive or the like can be used to secure the pencil 412 within the recess 434. The housing 402 and the closure 432 can be made from various materials including, without limitation, plastic (e.g., biodegradable) or metal. The closure 432 can snap-fit to or friction-fit engage the open end 406 of the housing 402. Instead of having a simple tapered end, a brush (e.g., a lip brush, an eyelash brush, an eyebrow brush, a plain brush, or the like) can be formed on or otherwise attached to the end of the closure 432 distal from the housing 402. The closure 432 includes a gripping surface area 436. The gripping surface area 436 can be in the form of a plurality of longitudinal grooves along the exterior that aid allow a user to manually grasp the closure 432. In the alternative, the gripping surface area 436 can be relatively smooth or have a roughened, texturized surface. In another alternative, the gripping surface area 436 of the closure 432 can be many-sided and angular (i.e., the exterior of the closure 432 looks polygonal in cross-section).

The housing 402 includes a mechanism 438 for removably coupling the housing 402 to the pencil 412. The removably coupling mechanism 438 comes in various forms including, without limitation, the closure 432, a tubular insert 444 (described below), a retention mechanism 440 that engages the pencil 412 (e.g., a retention ring, a collar, a snap-fit mechanism (not shown for clarity), or a locking mechanism (not shown) for holding the pencil 412 in a first position and releasing the pencil 412 for moving between the first position and a second position, or one or more of the foregoing in combination). The retention mechanism 440, in the form of a collar, can come in various forms including, without limitation, a friction-fit or a compression collar. The snap-fit mechanism can be comprised of a tab (not shown) disposed on a neck 442 of the closure 432 that removably engages an annular recess (not shown) of the insert 444. The retention mechanism 440 can be a stand-alone component or, in the alternative, can be formed as part of the insert 444.

Figure 5:
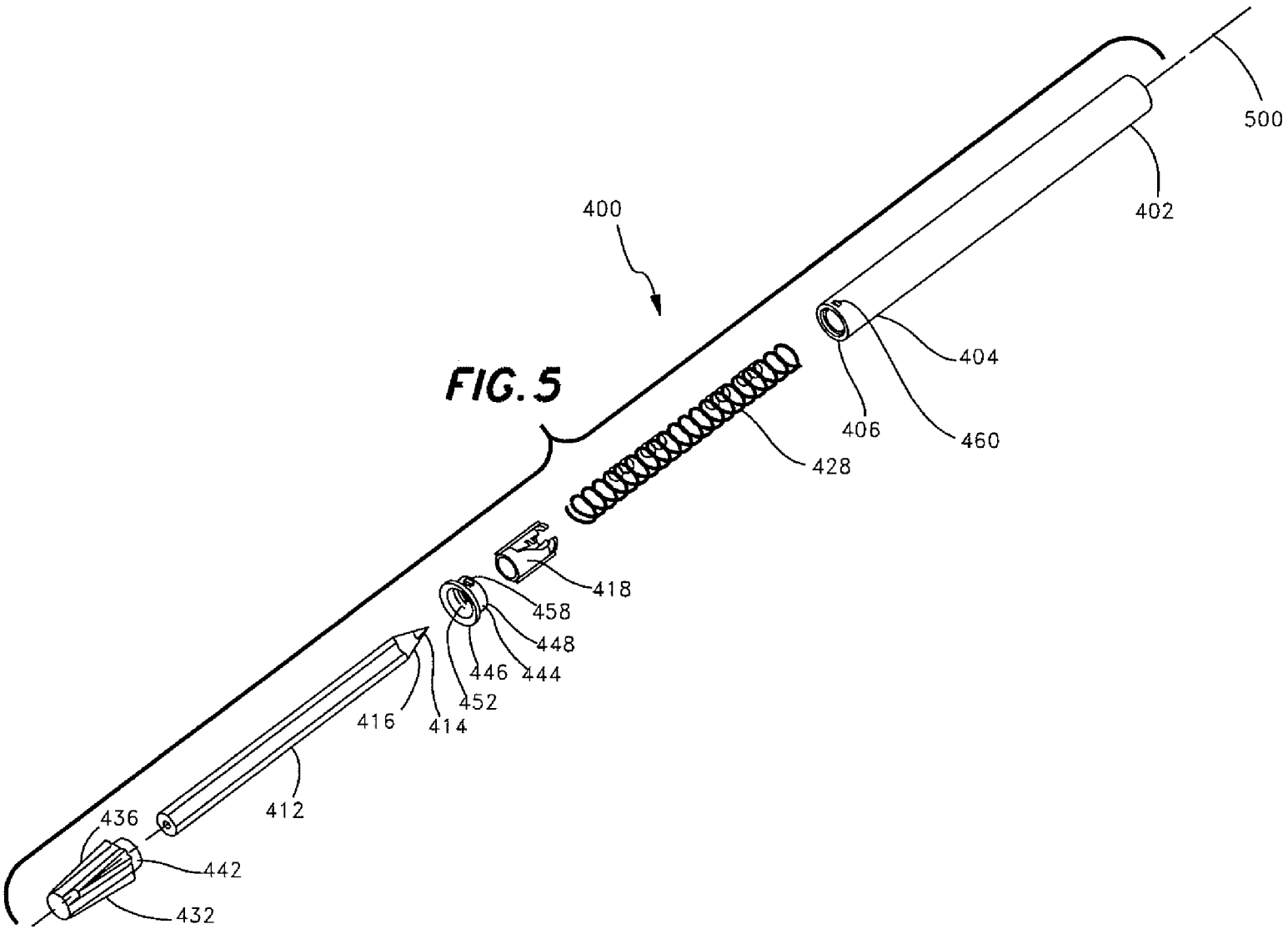
FIG. 5 is a exploded perspective view of firth embodiment of a pencil sharpening device.
Figure 6:
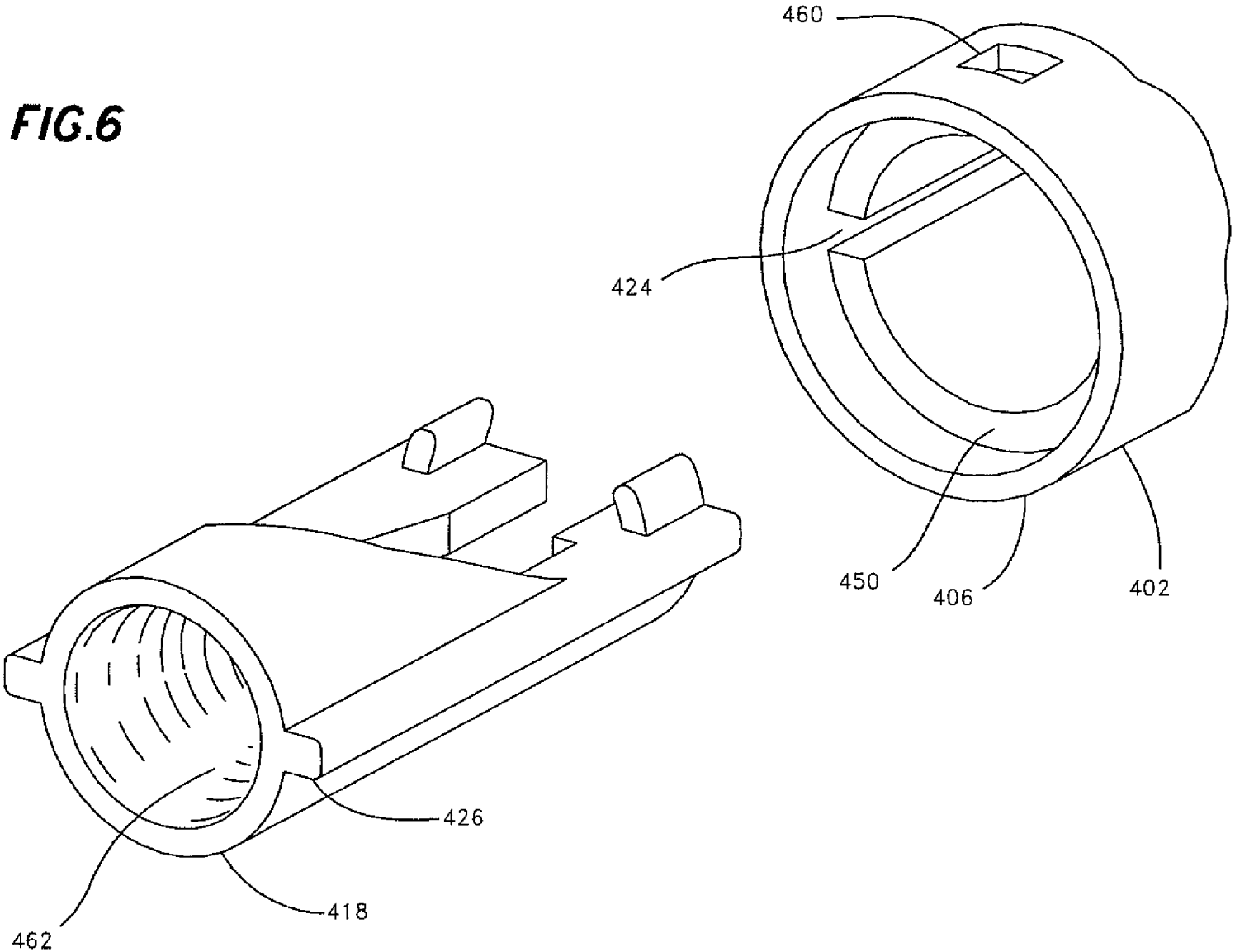
FIG. 6 is an exploded perspective view of movement of a sharpener with respect to a pencil sharpener cap according to the embodiment of FIG. 5.
Figure 7:
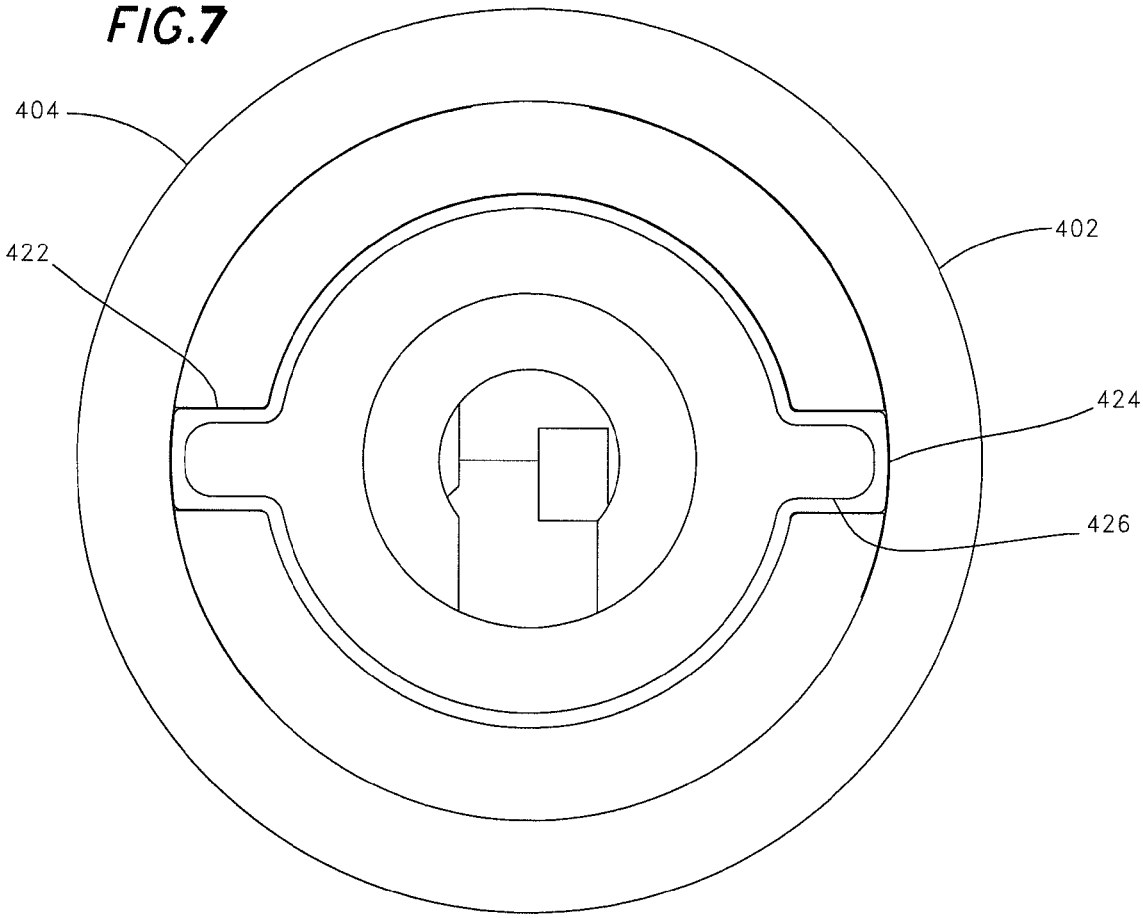
FIG. 7 is a cross-sectional view of the sharpener engaging the pencil sharpener cap of FIG. 6.
Figure 12:
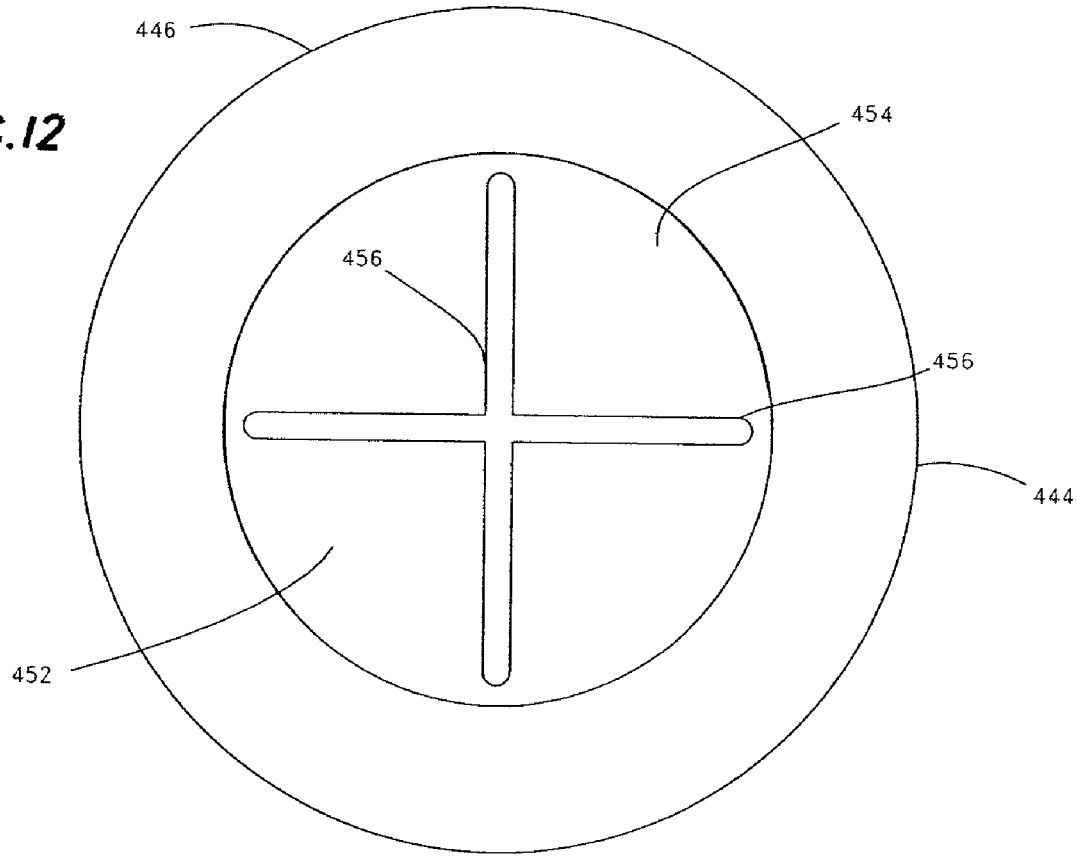
FIG. 12 is a cross-sectional view of an insert illustrating a flexible membrane having slits.

The pencil sharpener assembly 400 includes the tubular insert 444 having an annular rim 446 and a neck 448. The insert 444 aids in retaining the shavings 430 within the inner cavity 410. The insert 444 is at least partially disposed within the open end 406 of the housing 402 (via the neck 448 of the insert 448 being disposed within the housing 402, abutting against a shoulder 450 within the housing 402), between the pencil 412 and the housing 402, with the insert 444 (and the rim 446, in particular) disposed between the closure 432 and the housing 402. As seen in FIGS. 5 and 12, the insert 444 comprises a central bore 452 and the neck 448 has a flexible membrane 454 extending across an aperture at one end of the bore 452. The membrane 454 has slits 456 are substantially aligned with the aperture to aid in retaining the shavings 430 within the housing 402. The slits 456 of the insert 444 can be in various forms including, without limitation, the form of a central cross-slit valve. The insert 444 engages the housing 402 via a tab 458 extending away from the neck 448 of the insert 444. The tab 458 engages an aperture 460 on the housing 402 near the open end 406. In the alternative, the insert 444 could be eliminated from the assembly 400 if the closure 432 or the pencil 412 included a tab (similar and/or identical to the tab 458) that engages the aperture 460. In this alternative, the pencil 412 could include a plurality of tabs disposed at spaced intervals along the pencil 412 that would allow the pencil 412 to engage the aperture 460 at various lengths along the pencil 412. The insert 444 can be made of various materials including, without limitation, plastic, rubber or any elastomeric material.

Figure 10:
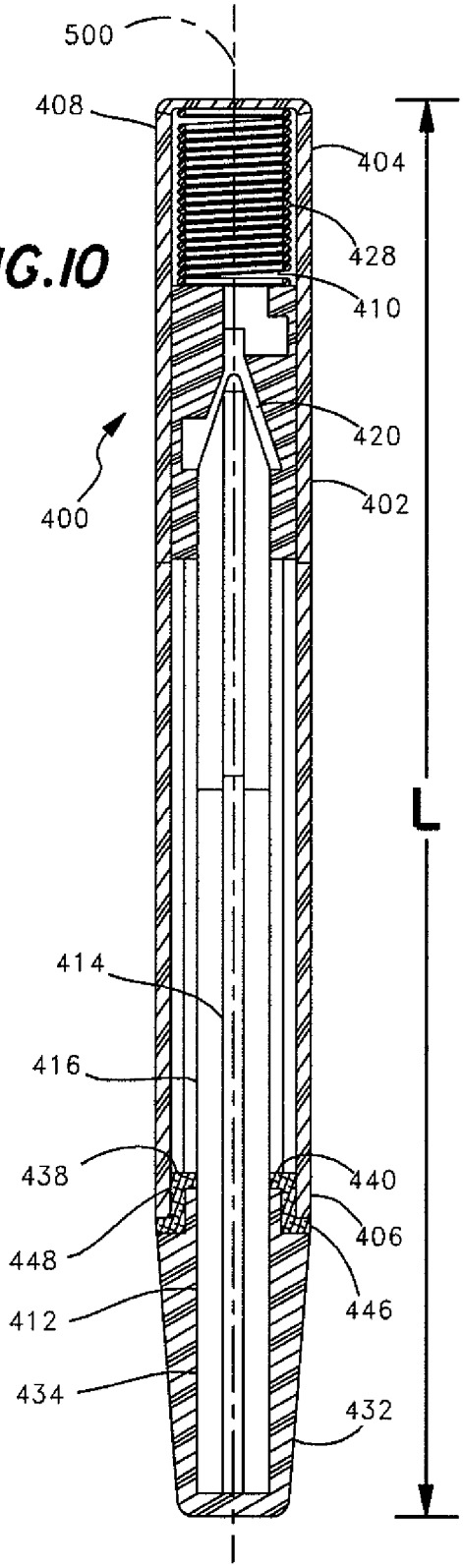
FIG. 10 is a cross-sectional view of a new pencil in the pencil sharpening device taken generally along line 10-10 of FIG. 9.
Figure 11:
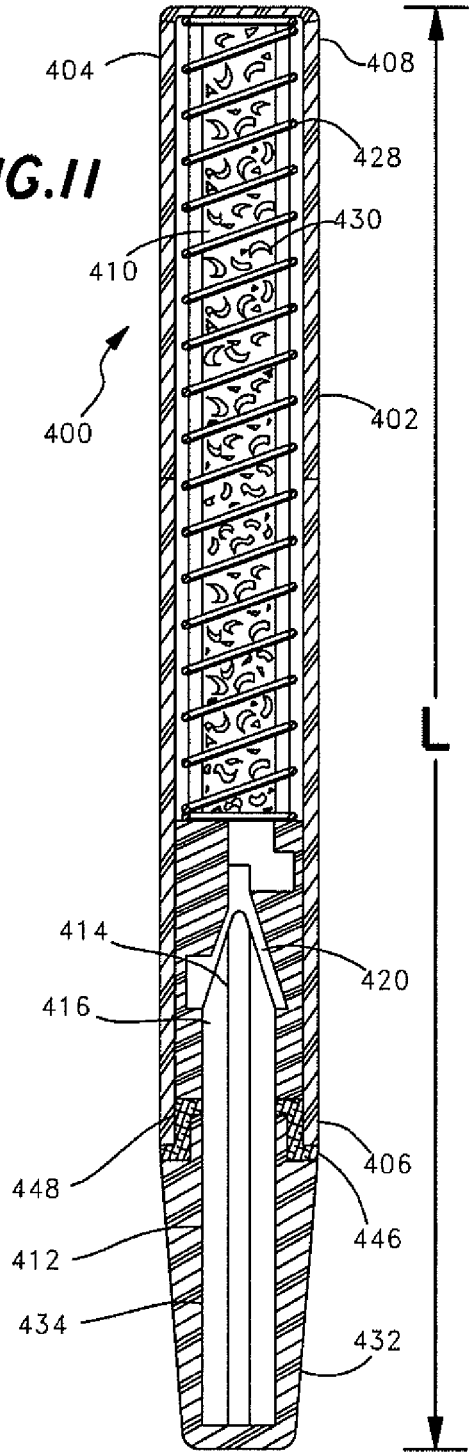
FIG. 11 is a cross-sectional view of the pencil sharpening device with a used pencil.

As seen in FIGS. 10 and 11, a combined longitudinal length L of the housing 402, the pencil 412 and the closure 432 in an engaged configuration remains approximately constant as the pencil 412 decreases in length due to sharpening. As seen in FIGS. 5 and 10, the housing 402, the pencil 412, the sharpener 418, the linear force mechanism 428, and the closure 432 are generally coaxial about a longitudinal axis 500.

In the alternative, an embodiment similar to that described above with respect to FIGS. 5-12 could include a platform slidably disposed within the inner cavity 410 of the housing. A linear compression spring could be disposed between the platform and the closed end 408 of the housing that would bias the platform towards the open end 406 of the housing. One end of a torsional spring could be connected to the other side of the platform with the other end of the torsional spring connected to a sharpener. Instead of linear grooves in the wall defining the inner cavity 410 of the housing, the grooves could spiral along the length of the housing. The sharpener would include spiral tabs that would engage the grooves and cause the sharpener to rotate as the sharpener moved between the ends 406, 408 of the housing. Depending on the strength of the compression spring, the torsional spring may or may not be necessary to provide torsional force to the sharpener to aid the sharpener in its spiral movement. The torsional spring may be disposed about a guide, in the form of a rod or the like, that extends away from the sharpener towards the closed end 408 of the housing 40 in order to keep the sharpener centered along the longitudinal axis 500 of the housing. This also aids the sharpener in its rotation about the longitudinal axis 500 as the sharpener moves between open and closed ends of the housing in both directions.

Additional embodiments of the present invention may be made by combining various elements from one of the above-described embodiments with various elements from another one or more of the above-described embodiments. For example, one could adapt the mechanism 300 for changing the size of the reservoir 200 illustrated in FIG. 4 for use with the cap 10 illustrated in FIG. 1.

Figure 8:
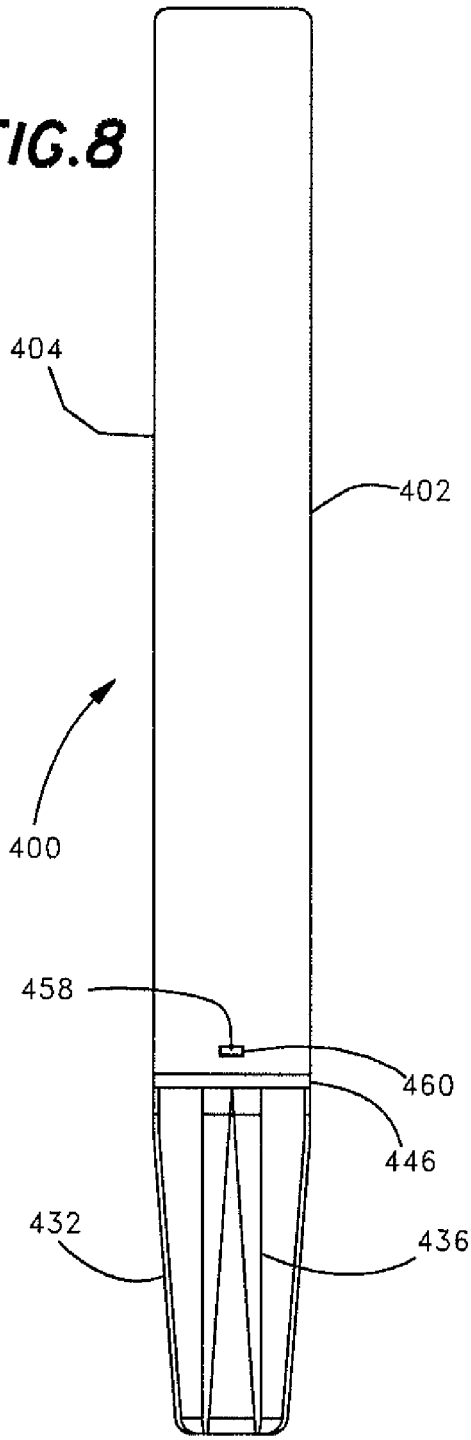
FIGS. 8 and 9 are front and rear views of the pencil sharpening device of FIG. 5.
Figure 9:
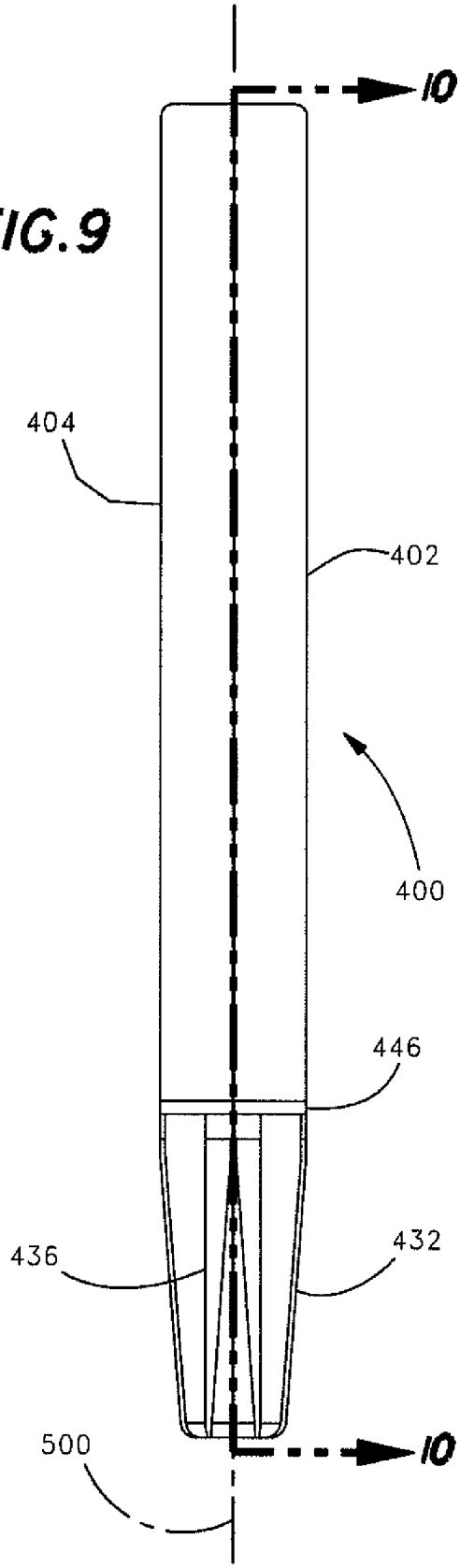

In use, the pencil sharpener assembly 400 starts off with the closure 432 engaged with the housing 402, as seen in FIGS. 8 and 9. A user disengages the closure 432 from the housing 402. As the pencil 412 is engaged to the closure 432, as the user pulls the closure 432 away from the housing 402 generally along the longitudinal axis 500, this extracts the pencil 412 from the housing 402, also disengaging the removably coupling mechanism 438 that coupled the pencil 412 to the housing 402. As the pencil 412 is removed from the housing 402, pressure from the pencil 412 pushing the sharpener 418 towards the closed end 408 of the housing 402 is reduced and the linear force mechanism 428 biases the sharpener 418 along the guiding mechanism 422 towards the open end 406 of the housing 402 where movement of the sharpener 418 is halted when an end of the sharpener 418 abuts against an end of the neck 448 of the insert 444. As the pencil 412 is removed, the pencil 412 is still at least partially received within a sharpening recess 462 of the sharpener 418 until movement of the sharpener 418 towards the open end 406 of the housing 402 is halted by the insert 444, completely disengaging the pencil 412 from the sharpener 418. As the pencil 412 is pulled through the membrane 454 of the insert 444, the slits 456 close behind the pencil 412 and prevent any pencil shavings 430 that might be present in the inner cavity 410 of the housing 402 from escaping the housing 402. Once the pencil 412 is removed from the housing 402, the user is free to use an exposed tip of the center portion 414 of the pencil 412 for any purpose, such as applying make-up (if a make-up pencil) or drawing (if any type of pencil). Use of the pencil 412 wears down the tip of the "lead" forming the center portion 414 of the pencil 412. Once the tip of the center portion 414 has worn down enough, the tip of the center portion 414 needs to be sharpened.

In order to sharpen the pencil 412, the user needs to re-engage the pencil 412 and/or closure 432 with the housing 402. The user does this by reversing the process described above. The user inserts the pencil 412 into the housing 402 by inserting the pencil 412 through the bore 452 of the insert 444, past the slits 456 of the membrane 454 until the pencil 412 enters the sharpening recess 462 of the sharpener 418 and the tip of the pencil is adjacent to and able to engage the cutter 420 of the sharpener 418.

The pencil 412 is sharpened by rotation of the pencil 412 relative to the housing 402 such that the cutter 420 shaves away portions of the center and outer portions 414, 416 of the pencil 412. The shavings 430 of the pencil 412 will enter into the inner cavity 410. Where the assembly 400 includes the closure 432 engaging the pencil 412, rotation of the closure 432 relative to the housing 402 also results in sharpening of the pencil 412 as the pencil 412 will rotate with the closure 432. When the closure 432 (including the pencil 412) engages the housing 402, due to the linear force mechanism 428 biasing the sharpener 418 against the pencil 412, as the length of the pencil 412 decreases due to sharpening, the portion of the inner cavity 410 available as a shavings reservoir will increase as the end of the sharpener 418 defines the first end of the shavings reservoir and the position of the first end of the sharpener 418 within the inner cavity 410 is determined by the length of the pencil 412. Naturally, when the pencil 412 is removed from the housing 402, the linear force mechanism 428 biases the sharpener 418 against the insert 444 and the shavings reservoir of the inner cavity 410 is at its maximum volume.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention. Moreover, in interpreting both the specification and the claims, all terms should be interpreted in the broadest reasonable manner possible that is consistent with the specification. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A pencil housing and sharpener comprising:

a housing having an inner cavity for receiving at least a portion of a pencil therein, the pencil comprising a center portion and an outer portion generally coaxial with the center portion;

a sharpener longitudinally slidable within the inner cavity for sharpening the center and outer portions of the pencil, the sharpener being non-rotatable relative to the housing; and a spring for providing a linear force to the sharpener to move the sharpener between open and closed ends of the housing, the spring being disposed between the sharpener and the closed end of the housing;

a removable closure having a recess for receiving an end of the pencil such that the pencil is non-rotatable relative to the closure, the closure mating with the housing to encase the pencil, the closure being rotatable relative to the housing to cause rotation of the pencil relative to the sharpener, said sharpener advancing from the closed end to the open end as the pencil decreases in length, thus increasing the capacity of a shavings reservoir in the inner cavity between the sharpener and the closed end.

2. The pencil housing and sharpener of claim 1, wherein the housing comprises a substantially tubular body.

3. The pencil housing and sharpener of claim 1, wherein the inner cavity retains the shavings between the sharpener and the closed end of the housing.

4. The pencil housing and sharpener of claim 1, wherein the housing includes means for removably coupling the housing to the pencil.

5. The pencil housing and sharpener of claim 4, wherein the removably coupling means comprises a retention ring that engages the pencil.

6. The pencil housing and sharpener of claim 1, wherein the closure includes a gripping surface area.

7. The pencil housing and sharpener of claim 1, including means for guiding the sharpener between open and closed ends of the housing.

8. The pencil housing and sharpener of claim 7, wherein the guiding means comprises a pair of parallel grooves disposed on opposite sides of the inner cavity, and the sharpener engages the grooves.

9. The pencil housing and sharpener of claim 7, wherein the guiding means comprises a pair of tabs extending from the sharpener, and each tab engages the housing.

10. The pencil housing and sharpener of claim 1, including an insert disposed within the open end of the housing, between the pencil and the housing.

11. The pencil housing and sharpener of claim 10, wherein the insert comprises an aperture and a flexible membrane having slits substantially aligned with the aperture for retention of pencil shavings within the housing.

* * * * *